United States Patent [19]

O'Brien

[11] 4,303,348

[45] Dec. 1, 1981

[54] GUTTER CLEANING DEVICE

[76] Inventor: Edward P. O'Brien, 9411 12th NE., Seattle, Wash. 98115

[21] Appl. No.: 128,407

[22] Filed: Mar. 10, 1980

[51] Int. Cl.[3] ..... A46B 11/02; A47L 13/03

[52] U.S. Cl. ..... 401/137; 15/236 R; 239/532; 401/289; 401/290

[58] Field of Search ..... 401/289, 290, 137, 27, 401/193, 268, 263; 239/280, 532; 15/236 R

[56] References Cited

U.S. PATENT DOCUMENTS

| | | | |
|---|---|---|---|
| 1,097,122 | 5/1914 | Engstrom | 401/290 X |
| 1,663,439 | 3/1928 | Christianson | 401/137 X |
| 2,552,631 | 5/1951 | Jilbert | 401/279 X |
| 2,910,711 | 11/1959 | Mizelle | 401/48 |
| 3,023,971 | 3/1962 | Milhous | 401/137 |
| 3,041,655 | 7/1962 | Entler | 401/289 X |
| 3,983,595 | 10/1976 | Knudsen et al. | 15/236 R |
| 4,150,793 | 4/1979 | Russo | 239/532 |

FOREIGN PATENT DOCUMENTS

| | | | |
|---|---|---|---|
| 596817 | 3/1978 | Switzerland | 15/236 R |

*Primary Examiner*—Steven A. Bratlie

*Attorney, Agent, or Firm*—Seed, Berry, Vernon & Baynham

[57] ABSTRACT

A pair of oppositely directed curved scraper blades are mounted to the end of a reversely bent handle which serves as a conduit for water. Tabs are formed on the end of the conduit to clamp a removable brush at the end of the conduit.

3 Claims, 6 Drawing Figures

GUTTER CLEANING DEVICE

BACKGROUND OF THE INVENTION

1. Field of the Invention

This invention relates to apparatus for cleaning gutters and the like and, more particularly, to a gutter cleaning device operated by an individual standing below the gutter.

2. Prior Art Relating to the Disclosure

Eaves trough gutters are designed to carry away runoff water from the roof of a building. Quite often, however, debris such as leaves, dirt, needles, roofing material granules and the like, accumulates in the gutter and is not flushed away by the flow of water in the gutter. Accumulated debris often sticks to the interior surfaces of the gutter and inhibits free flow of water and causes further accumulation of debris. If the debris is not periodically removed, it is apparent that the gutter soon becomes clogged with such debris, causing backup and restricted flow of water within the gutter. During heavy rainfall, runoff water often overflows the gutter and runs down the side of the building and may seep into the eaves. The accumulation of debris and standing water in wooden gutters promotes deterioration. Both wooden and sheet metal gutters which are filled with debris and accumulated water or ice weigh a substantial amount which strains their mountings and causes the fasteners to be worked loose from the building.

The most direct way of cleaning a gutter is for a maintenance person to mount a ladder, manually scrape or brush the debris loose from the interior of the gutter and flush with water or otherwise remove the accumulated debris. Use of a ladder is hazardous particularly when the gutters are located high above ground level.

Various gutter cleaning devices have heretofore been available which permit a maintenance person to stand on the ground and remotely clean and remove the debris from a gutter. U.S. Pat. No. 2,910,711 discloses a gutter cleaner having an elongated tubular handle with a reversely bent upper end to which is mounted a flexible scraper extending in one direction and a water nozzle facing in the opposite direction. U.S. Pat. No. 3,041,655 discloses a gutter cleaner having a similar handle to which is mounted a flat scraper blade which extends in one direction along the gutter and which has a water channel formed along its top surface. Both of these prior gutter cleaners are adapted to operate in only one direction along a gutter and their single scrapers are not contoured to match the gutter shape nor to easily pitch debris from the gutter.

SUMMARY OF THE INVENTION

It is therefore an object of this invention to provide a device for cleaning by scraping or scrubbing or both and for removing debris from a gutter from a position remote from the gutter.

It is another object of the invention to provide a gutter cleaning device which is inexpensive to manufacture and simple to operate.

It is another object of the invention to provide a gutter cleaning device which includes a replaceable brush for removing debris accumulated on the interior surfaces of a gutter and a pair of oppositely extending scrapers, which provide the ability to scrape and remove debris from a gutter in either direction or with a back-and-forth action along the length of a gutter.

Basically, these and other objects of the invention are achieved by a gutter cleaning device which is operable from a position remote from the gutter, such as on the ground beneath the gutter, using an elongated, vertically extending hollow conduit which serves as a handle for the device. A pair of oppositely extending curved scraper blades are mounted at the end of a reverse bend of the conduit, permitting the gutter cleaner to be conveniently positioned within the gutter and debris to be pitched from the gutter. A contoured brush is removably mounted to the end of the conduit and provides a means for scrubbing the interior of the gutter, one embodiment of which includes a contoured brush having a wedge-shaped base which is clamped in position by a pair of oppositely positioned tabs, or alternative dovetailed cutouts, at the end of the conduit. Water flows through the conduit and assists in flushing debris from the gutter. The invention advantageously provides a device for scraping, brushing, flushing and removing accumulated debris in a gutter with the operator safely positioned on the ground beneath the gutter.

DETAILED DESCRIPTION OF THE PREFERRED EMBODIMENTS

Figures 1, 2, 3, 4, 5, 6:
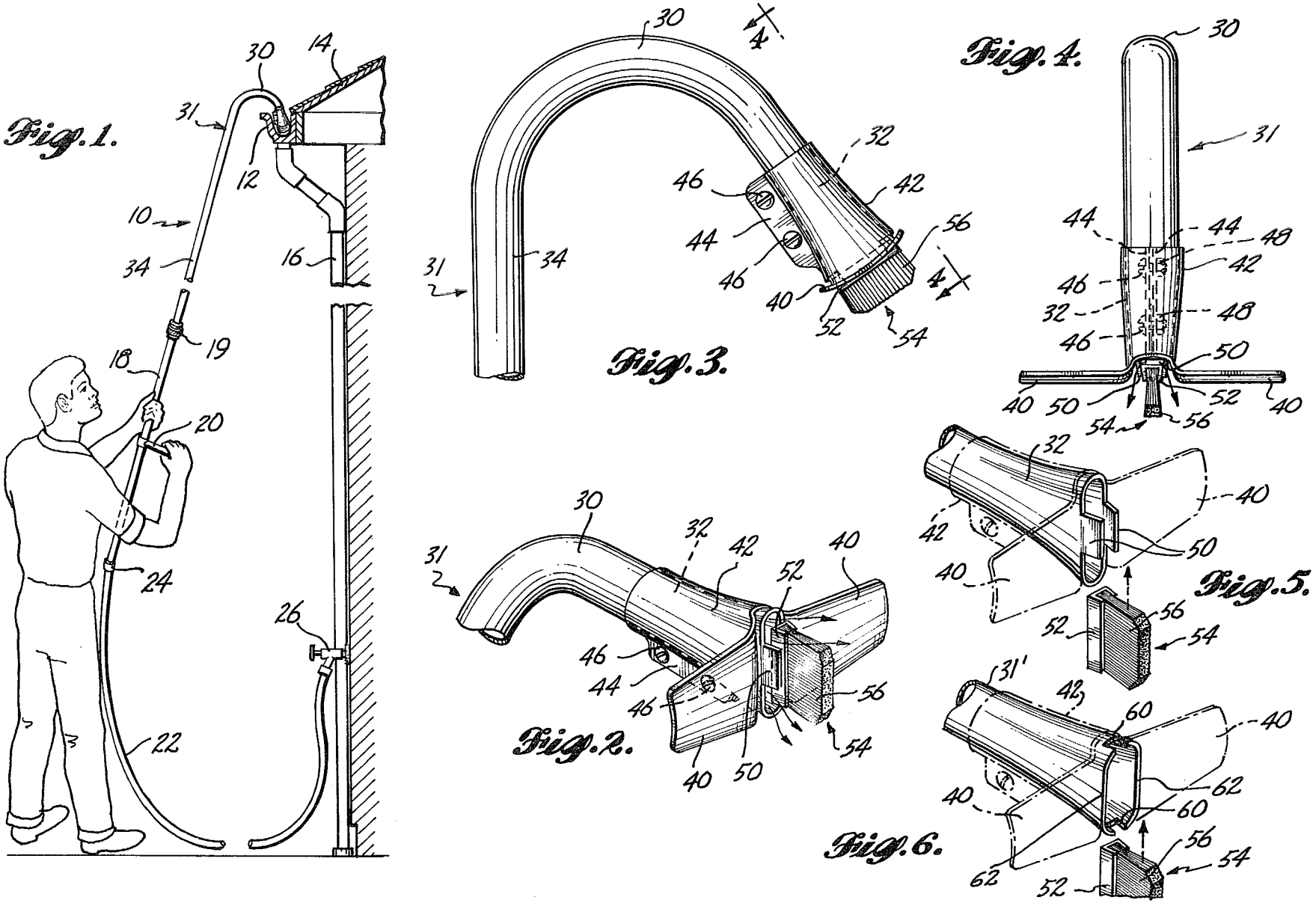
FIG. 1 is an elevation view of an operator using a gutter cleaning device according to the invention.
FIG. 2 is an assembled isometric view of a gutter cleaning device.
FIG. 3 is a side elevation view of a gutter cleaning device.
FIG. 4 is a front elevation view of a gutter cleaning device.
FIG. 5 is an exploded isometric view showing a brush removed from its mounting.
FIG. 6 is an isometric view of a gutter cleaning device showing an alternative structure for mounting the brush.

FIG. 1 shows an operator standing safely on the ground and using a gutter cleaning device assembly 10 for scraping, brushing and removing accumulated debris from a gutter 12, while flushing the gutter 12 with water. The gutter 12 is mounted along the eaves of a building so as to collect water flowing down the roof 14 of the building. The gutter 12 is shown in the illustration as a wooden gutter having a slightly concave bottom interior surface, and the gutter 12 is pitched such that water flows by gravity to a downspout assembly 16 which directs the water away from the building.

The gutter cleaning device 10 includes one or more conduit sections 18 which form a handle and are connected together by conventional threaded couplings 19 to form an elongated, vertically extending handle assembly having a convenient length. The conduit sections are formed from three-quarter inch aluminum rigid conduit which provides sufficient strength for the structure while being lightweight and easily fabricated. An adjustably positionable operating lever 20 is removably fastened to one of the conduit sections to assist the operator in manipulating the gutter cleaning device 10 as he moves along the ground beneath the gutter 12. A hose, such as a conventional garden hose 22, is connected to the lower end of the cleaning device assembly 10 by a conventional coupler 24. Water is provided to the gutter cleaning device and flows under pressure from a faucet 26. In operation, the operator moves along the ground and manipulates the gutter cleaning device 10 along the length of the gutter 12 so that debris is brushed, scraped, pitched and flushed from the gutter 12.

FIG. 2 shows the operative components for performing the foregoing functions. These components are located at the end of a reverse bend 30 formed in the upper section of a conduit section 31. FIG. 3 shows that the end portion 32 of the conduit section 31 is formed such that the conduit 31 is bent less than 180° and is not parallel to the main lower portion 34 of the conduit. This permits an operator to stand at a distance from the wall of the building, not directly beneath the gutter 12, and hold the handle conduit section 18 in a substantially vertical position.

FIG. 2 shows a pair of oppositely extending scraper blades 40 mounted at the reversely bent end portion 32 of the conduit section 31. The blades 40 extend perpendicularly from the conduit portion 32 and are adapted to be positioned along the length of a gutter. FIG. 3 shows that a blade 40 has a transverse cross-section with an upwardly curved configuration which is designed to approximately match the curvature of the interior of a wooden gutter. The two blades 40 each extend in opposite directions so that the operator can scrape and pitch debris from the gutter in either direction without having to remove or readjust the assembly. The blades 40 in this embodiment are integrally connected to a collar 42 which extends around the end of the conduit portion 32. A pair of outwardly extending longitudinal flanges 44 each radially extend from opposite ends of the collar 42 and are drawn together by one of a pair of bolts 46 which each threadably engages a nut 48. The collar 42 thus clamps around the end of the conduit section 32, and integrally supports the blades 40. Various sizes of blades are provided to accommodate different sizes of gutters. The free end of the conduit section 31 has an oblong, flattened configuration as shown in FIG. 2, and the collar 42 is shaped near its junction with the blades 40 to conform to that configuration. At the free end of the conduit section 31 are formed a pair of tabs 50 which angle slightly inwardly as shown. The tabs 50 are biased by the adjustable collar 42 to hold a wedge-shaped base of a brush assembly 54. The brush bristles 56 extend parallel to the axis of the end portion 32 of the conduit section 31 and are shaped so that the ends have a beveled configuration conforming to the contour of a gutter interior. In operating the gutter cleaning device, the handle 18 is positioned so that the brush bristles 56 perpendicularly engage and brush debris from the interior surface of a gutter 12 as the gutter cleaning assembly 10 is moved longitudinally along the gutter. Water flows through the conduit section 31 and extis as shown by the flow lines in FIGS. 2 and 4 to flush the gutter. The brush 54 when worn is removable from the cleaning device assembly 10 as indicated in FIG. 5. Different sizes of brushes are provided to accommodate different size gutters, as required.

FIG. 6 shows an optional configuration for the outer end of the conduit in which a pair of oppositely positioned dovetailed cutouts 60 are formed at the end of a conduit section 31' for receiving the wedge-shaped base 52 of the brush assembly 54. The projecting portions 62 of the conduit section 31' between the cutouts 60 are biased by the collar 42 and cause the base 52 of the brush assembly 54 to be frictionally held within the apertures 60.

In operation, an appropriate number of conduit sections 18 are coupled together end-to-end, and the far end of the gutter cleaning assembly 10 is positioned within a gutter 12 as shown in FIG. 1. The assembly 10 is operated such that the brush bristles 56 contact and brush debris from the interior surface of the gutter. The blades 40 are used to scrape debris from the interior of the gutter. Loose debris is scooped and pitched from the gutter using either one of the blades 40. Water flows through the conduit section 31 and flushes debris from the gutter.

While particular embodiments of the invention have been shown and described, the invention is not limited thereto since many modifications may be made. It is therefore contemplated to cover by the present application any and all such modifications that fall within the true spirit and scope of the basic underlying principles disclosed and claimed herein.

I claim:

1. A gutter cleaning device for cleaning debris from a gutter, comprising:

(a) a handle including an elongated, substantially vertical conduit which has a reverse bend near one end and which is capable of carrying water under pressure to the gutter to flush loose debris from the gutter;

(b) a scrub brush releasably attached to the end of the conduit so that water exiting the conduit flows immediately around the sides of the brush to aid scrubbing of debris from the gutter; and (c) two oppositely extending scraper blades which (i) are attached to the conduit above the end so that the water enters the gutter below the blades when the device is postioned in the gutter and (ii) are adapted to scoop loose debris from the gutter.

2. The device of claim 1 wherein the blades are shaped substantially to conform to the curvature of a standard gutter.

3. The device of claim 1 or 2 wherein the brush includes a wedge-shaped base and the end of the conduit has a pair of oppositely positioned, dovetail cutouts to receive and to hold the wedge-shaped base.

* * * * *